US007539447B2

(12) United States Patent
Hattori et al.

(10) Patent No.: US 7,539,447 B2
(45) **Date of Patent: *May 26, 2009**

(54) IMAGE-FORMING DEVICE FOR ABSORBING VIBRATION OF GUIDE PLATE

(75) Inventors: Makoto Hattori, Nagoya (JP); Hiroshi Tokuda, Aichi-ken (JP); Hideaki Deguchi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/878,502

(22) Filed: Jul. 25, 2007

(65) Prior Publication Data

US 2007/0269242 A1 Nov. 22, 2007

Related U.S. Application Data

(63) Continuation-in-part of application No. 11/340,539, filed on Jan. 27, 2006.

(30) Foreign Application Priority Data

Jan. 28, 2005 (JP) ..... P2005-021992
Jan. 28, 2005 (JP) ..... P2005-021993
Jul. 25, 2006 (JP) ..... P2006-202211

(51) Int. Cl.
*G03G 15/16* (2006.01)

(52) U.S. Cl. ..... 399/316; 399/317

(58) Field of Classification Search ..... 399/316, 399/317

See application file for complete search history.

(56) References Cited

U.S. PATENT DOCUMENTS 4,882,606 A * 11/1989 Deguchi ..... 399/316
5,144,383 A * 9/1992 Murano et al. ..... 399/316
5,155,539 A * 10/1992 Yamaguchi et al. ..... 399/317
5,220,396 A * 6/1993 Monma et al. ..... 399/121
5,592,278 A * 1/1997 Sato et al. ..... 399/384
2005/0069343 A1 3/2005 Deguchi et al.
2006/0171760 A1 8/2006 Deguchi
2007/0269243 A1 * 11/2007 Uehara et al. ..... 399/316

(Continued)

FOREIGN PATENT DOCUMENTS

CN 1073534 A 6/1993

(Continued)

OTHER PUBLICATIONS

European Search Report issued in European Patent Application No. EP 06 00 1618 dated May 15, 2006.

(Continued)

*Primary Examiner*—David M Gray
*Assistant Examiner*—Ryan D Walsh
(74) *Attorney, Agent, or Firm*—McDermott Will & Emery LLP

(57) ABSTRACT

An image-forming device includes a photosensitive drum, a transfer roller, a guide plate for guiding the paper toward the photosensitive drum, and a sponge fixed to the bottom surface of the guide plate. The sponge is softer than the guide plate, so that it can absorb vibrations in the guide plate when the trailing edge of the paper leaves the guide plate.

21 Claims, 8 Drawing Sheets

U.S. PATENT DOCUMENTS

2007/0269244 A1* 11/2007 Miwa et al. ..... 399/316

FOREIGN PATENT DOCUMENTS

| | | | |
|---|---|---|---|
| EP | 0549089 | A1 | 6/1993 |
| EP | 1 031 891 | A | 8/2000 |
| JP | 59-206846 | | 11/1984 |
| JP | 63-43473 | | 3/1988 |
| JP | 2-136269 | U | 11/1990 |
| JP | 7-160129 | | 6/1995 |
| JP | 7-181815 | | 7/1995 |
| JP | 8-36313 | | 2/1996 |
| JP | 11-338279 | | 12/1999 |
| JP | 2002-072704 | | 3/2002 |
| JP | 2003-5535 | | 1/2003 |
| JP | 2006-208839 | | 8/2006 |
| JP | 2006-208840 | | 8/2006 |

OTHER PUBLICATIONS

Chinese Office Action with English translation issued in Chinese Patent Application No. 2006100071765, dated Jun. 27, 2008.

* cited by examiner

IMAGE-FORMING DEVICE FOR ABSORBING VIBRATION OF GUIDE PLATE

CROSS REFERENCE TO RELATED APPLICATION

This application is a continuation-in-part application of application Ser. No. 11/340,539 filed Jan. 27, 2006, claiming priorities from Japanese patent application Nos. 2005-21992 and 2005-21993 both filed Jan. 28, 2005. This application further claims priority from Japanese Patent Application No. 2006-202211 filed Jul. 25, 2006. The entire contents of these priority applications are incorporated herein by reference.

BACKGROUND OF THE INVENTION

1. Field of the Invention

The present invention relates to an image-forming device such as a laser printer, and to a process cartridge detachably provided in the image-forming device.

2. Description of the Related Art

Generally, laser printers and other electrophotographic image-forming devices are provided with a photosensitive drum for carrying a developer image, and a transfer roller disposed in contact with the photosensitive drum for attracting the developer image with a transfer bias applied to the transfer roller. When a sheet of paper passes between the photosensitive drum and the transfer roller, the developer image migrates toward the transfer roller and is transferred onto the paper, forming an image thereon. However, when the paper is separated from the photosensitive drum at a position upstream of a transfer position between the photosensitive drum and the transfer roller with respect to the paper-conveying direction, a pre-transfer may occur in which an electric field produced between the paper and the photosensitive drum causes developer to scatter from the photosensitive drum onto the paper.

To resolve this problem, a guide plate has conventionally been provided on the upstream side of the transfer position for guiding the paper toward the photosensitive drum in order to suppress pre-transfer. This technology is disclosed in Japanese unexamined patent application publication No. 2003-5535.

However, when the guide plate is formed of a film or other flexible member in the technology described above, the guide plate bent by the paper returns to its original position and flaps when the trailing edge (upstream end) of the paper leaves the guide plate, potentially generating noise (referred to as "flapping"). Further, the guide plate must be separated a certain distance from the transfer position to prevent the guide plate from contacting and damaging the surfaces of the photosensitive drum and the transfer roller. Accordingly, when the trailing edge of the paper passes over the edge of the guide plate, the trailing edge is no longer supported by the guide plate and can flap in the space between the transfer position and the guide plate. Such flapping in the trailing edge of the paper may cause problems in transferring developer, leading to a drop in quality of the images formed on paper.

SUMMARY OF THE INVENTION

Therefore, it is an object of the present invention to provide an image-forming device and a process cartridge capable of suppressing flapping noise from the guide plate, while improving the quality of images formed on the paper.

The above and other objects will be attained by an image-forming device that includes an image-carrying member, a transferring unit, a conveying unit, a guide plate, and a cushioning member. The image-carrying member carries a developer image. The transferring unit is disposed in confrontation with the image-carrying member and transfers the developer image on the image-carrying member to a recording sheet. The conveying unit conveys the recording sheet to a transfer position between the image-carrying member and the transferring unit. The guide plate supports the recording sheet conveyed by the conveying unit on the first surface and guiding the recording sheet toward the image-carrying member. The cushioning member is disposed at a side of the second surface of the guide plate. The cushioning member is formed from a material softer than a material of the guide plate. Further, it is desirable that the cushioning member protrude farther toward the image-carrying member than the first edge of the guide plate.

When the image-carrying member is a photosensitive drum, this photosensitive drum may be provided in a process cartridge that is detachably mounted in the image-forming device. In this case, the guide plate and the cushioning member may also be provided in the process cartridge.

By providing a cushioning member that is disposed at a side of the second surface and formed from a material softer than a material of the guide plate, the cushioning member can absorb vibrations in the guide plate when the trailing edge of the paper leaves the guide plate. Further, the cushioning member protruding farther toward the image-carrying member than the edge of the guide plate on the image-carrying member side is softer than the guide plate to reduce the possibility of damage to the image-carrying member from contact by the cushioning member. As a result, the cushioning member can be extended near the image-carrying member for supporting the trailing edge of the paper in the space between the transfer position and the guide plate, thereby restraining flapping of the trailing edge.

Since the cushioning member of the present invention can absorb vibrations in the guide plate, the structure of the present invention can suppress flapping noise from the guide plate. Further, since the cushioning member supports the trailing edge of the paper, the cushioning member can restrain flapping of the trailing edge of the paper, thereby improving the quality of images formed on the paper.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Next, a preferred embodiment of the present invention will be described.

Figure 1:
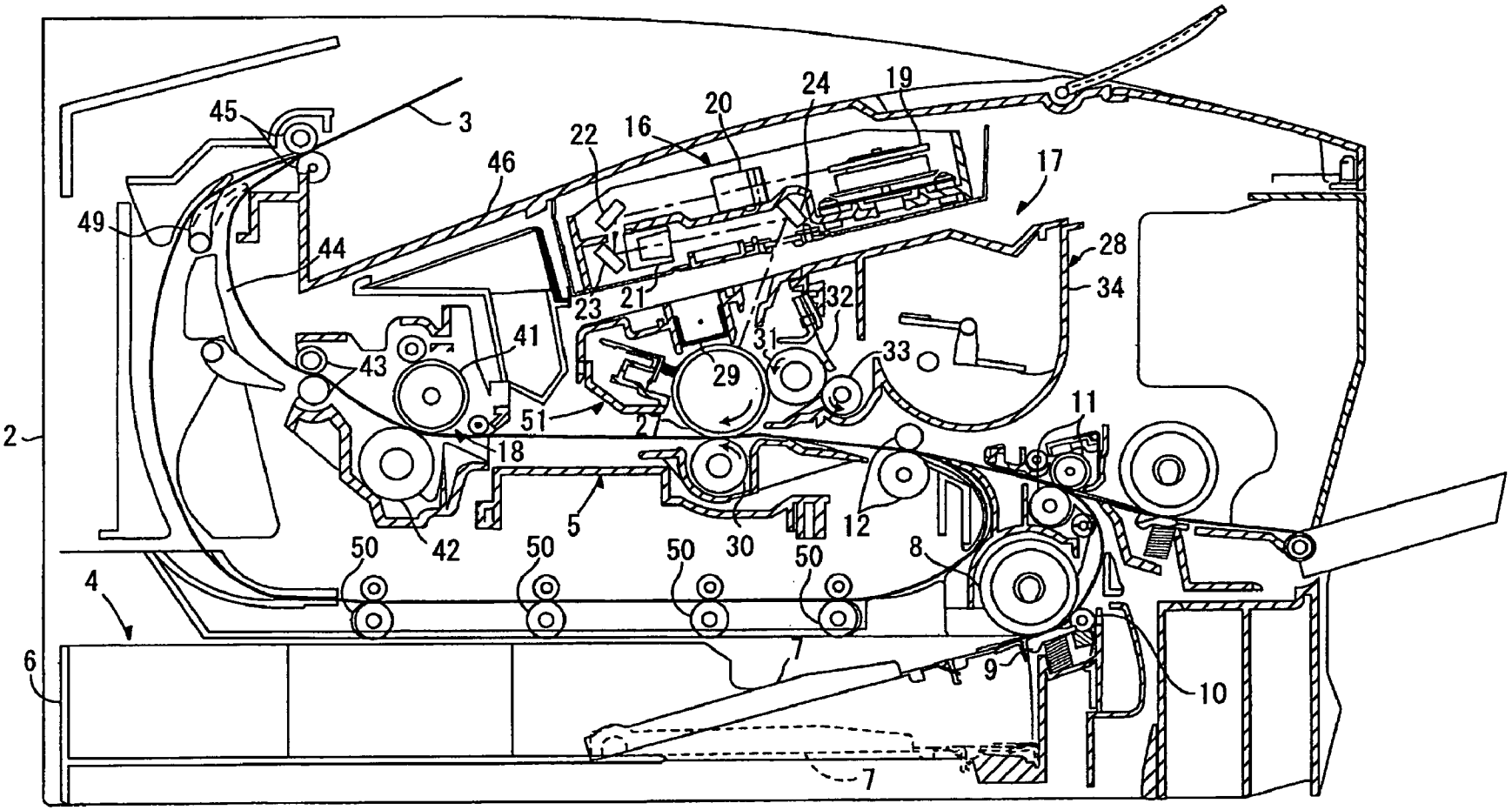
FIG. 1 is a side cross-sectional view of a laser printer serving as a preferred embodiment of the image-forming device according to the present invention.

First, the overall structure of a laser printer will be briefly described as an example of the image-forming device according to the present invention. FIG. 1 is a side cross-sectional view of a laser printer 1 serving as a preferred embodiment of the image-forming device according to the present invention. As shown in FIG. 1, the laser printer 1 includes a main casing 2 and, within the main casing 2, a feeding unit 4 for feeding sheets of a paper 3, and an image-forming unit 5 for forming images on the paper 3 supplied by the feeding unit 4.

The feeding unit 4 includes a paper tray 6 detachably mounted in the bottom section of the main casing 2, a paper-pressing plate 7 provided inside the paper tray 6, a feeding roller 8 and a feeding pad 9 disposed above one end of the paper tray 6, paper dust rollers 10 and 11 disposed downstream of the feeding roller 8 in the conveying direction of the paper 3, and registration rollers 12 disposed downstream of the paper dust rollers 10 and 11. In the following description, upstream or downstream in the paper-conveying direction may simply be referred to as "upstream" or "downstream," and the upstream edge or downstream edge of the sheet of paper 3 being conveyed may be referred to as the "trailing edge" or the "front edge," respectively.

In the feeding unit 4 having the construction described above, sheets of the paper 3 are loaded in the paper tray 6 and pressed toward the feeding roller 8 side by the paper-pressing plate 7. The paper 3 fed one sheet at a time by the feeding roller 8 and feeding pad 9 pass through the various rollers 10-12 and are conveyed by these rollers to the image-forming unit 5 (specifically, a transfer position C shown in FIG. 2).

The image-forming unit 5 includes a scanning unit 16, a process cartridge 17, and a fixing unit 18.

The scanning unit 16 is disposed in the upper section of the main casing 2 and includes a laser light-emitting element (not shown), a polygon mirror 19 that is driven to rotate, lenses 20 and 21, and reflecting mirrors 22, 23, and 24. The laser light-emitting element emits a laser beam based on image data. As indicated by the dotted line in FIG. 1, the laser beam sequentially passes through or is reflected off the polygon mirror 19, lens 20, reflecting mirror 22, reflecting mirror 23, lens 21, and reflecting mirror 24, and is irradiated in a high-speed scan onto the surface of a photosensitive drum 27 in the process cartridge 17 described next.

The process cartridge 17 is disposed beneath the scanning unit 16 and is constructed to be detachably mounted in the main casing 2. The outer frame of the process cartridge 17 is configured of a hollow casing 51, within which are primarily provided a developer cartridge 28, the photosensitive drum 27, a Scorotron charger 29, and a transfer roller 30.

The developer cartridge 28 is detachably mounted in the casing 51 and includes a developing roller 31, a thickness-regulating blade 32, a supply roller 33, and a toner hopper 34. The supply roller 33 rotates in the direction of the arrow (counterclockwise in FIG. 1) to supply toner from the toner hopper 34 to the developing roller 31. At this time, the toner is positively tribocharged between the supply roller 33 and developing roller 31. As the developing roller 31 rotates in the direction of the arrow (counterclockwise in FIG. 1), toner supplied onto the developing roller 31 passes between the developing roller 31 and the thickness-regulating blade 32 and is regulated to a thin film of a fixed thickness on the developing roller 31.

The photosensitive drum 27 is supported in the casing 51 so as to be capable of rotating in the direction of the arrow (clockwise in FIG. 1). The photosensitive drum 27 is configured of a main drum body that is grounded, and a positive-charging photosensitive layer of polycarbonate formed on the surface thereof.

The charger 29 is disposed above and in confrontation with the photosensitive drum 27 but separated a prescribed distance therefrom so as not to contact the photosensitive drum 27. The charger 29 is a positive-charging Scorotron charger that produces a corona discharge from a charging wire formed of tungsten or the like for charging the surface of the photosensitive drum 27 with a uniform positive polarity.

The transfer roller 30 is disposed below the photosensitive drum 27, confronting and contacting the same, and is supported in the casing 51 so as to be capable of rotating in the direction of the arrow (counterclockwise in FIG. 1). The transfer roller 30 is configured of a metal roller shaft coated with an electrically conductive rubber material. During a transfer operation, a transfer bias is applied to the transfer roller 30 through constant current control. A transfer position C (see FIG. 2) is formed at the point of contact between the transfer roller 30 and photosensitive drum 27 (nip point).

After the charger 29 charges the surface of the photosensitive drum 27 with a uniform positive polarity, the scanning unit 16 irradiates a laser beam in a high-speed scan over the surface of the photosensitive drum 27 based on image data. The areas of the photosensitive drum 27 exposed to the laser beam have a lower potential and form an electrostatic latent image. Here, the "electrostatic latent image" indicates areas on the surface of the photosensitive drum 27 carrying a uniformly positive charge that were exposed to the laser beam and, therefore, have a lower potential. As the developing roller 31 rotates, the toner carried on the developing roller 31 confronts and contacts the photosensitive drum 27, at which time toner is supplied to the electrostatic latent image formed on the surface of the photosensitive drum 27. The toner is selectively transferred to and carried on the surface of the photosensitive drum 27, developing the latent image into a visible image through reverse development to form a toner image on the photosensitive drum 27.

Figure 2:
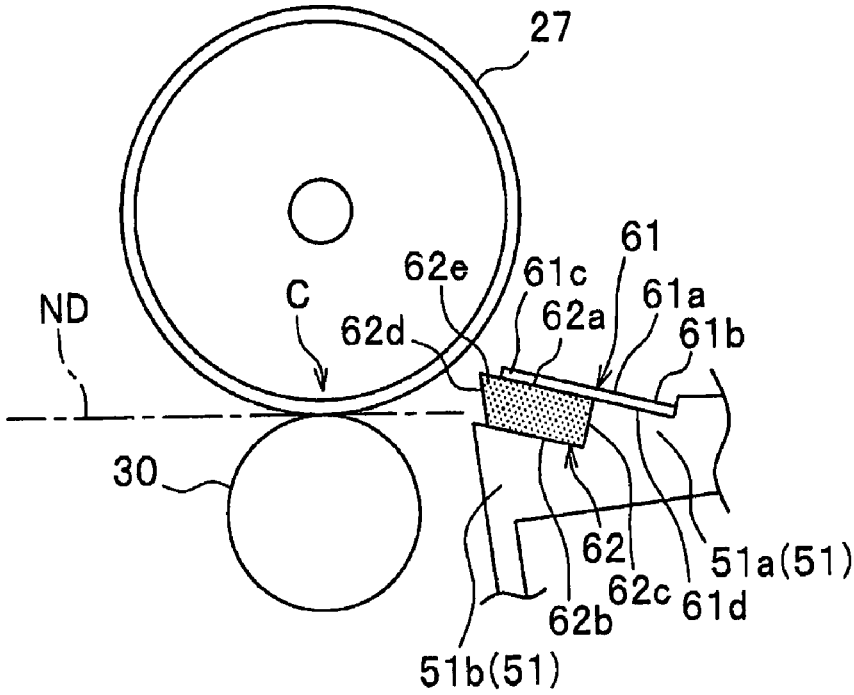
FIG. 2 is a cross-sectional view showing a simplified structure near a transfer position in the laser printer of FIG. 1.

As the photosensitive drum 27 and transfer roller 30 are driven to rotate, a sheet of the paper 3 is pinched between the photosensitive drum 27 and transfer roller 30 at the transfer position C shown in FIG. 2. The photosensitive drum 27 and transfer roller 30 convey the sheet of paper 3 while the toner image carried on the surface of the photosensitive drum 27 is transferred onto the paper 3.

The fixing unit 18 is disposed on the downstream side of the process cartridge 17 and includes a heating roller 41, a pressure roller 42 disposed in confrontation with the heating roller 41 and applying pressure to the same, and a pair of conveying rollers 43 disposed downstream of the heating roller 41 and pressure roller 42. The fixing unit 18 having this construction fixes the toner transferred onto the paper 3 with heat as the paper 3 passes between the heating roller 41 and pressure roller 42. Subsequently, the conveying rollers 43 convey the sheet of paper 3 along a discharge path 44. Discharge rollers 45 receive the paper 3 conveyed along the discharge path 44 and discharge the paper 3 onto a discharge tray 46. Alternatively, the sheet of paper 3 may be returned into the device by reversing the rotation of the discharge rollers 45 and switching a flapper 49. In this case, a plurality of reverse conveying rollers 50 convey the sheet of paper 3 in an inverted state back to the upstream side of the image-forming unit 5 to perform a duplex print.

Next, the structure of the area near the transfer position C, which structure is a feature of the present invention, will be described in greater detail. FIG. 2 is a side cross-sectional view showing a simplified structure near the transfer position C in the laser printer of FIG. 1. Some parts in the structure around the transfer position C in FIG. 1 have been omitted for the convenience of description.

As shown in FIG. 2, a guide plate 61 for guiding the paper 3 toward the photosensitive drum 27, and a sponge 62 are sequentially disposed with respect to the paper-conveying direction on the upstream side of the contact point (transfer position C) between the photosensitive drum 27 and transfer roller 30.

The guide plate 61 is a substantially rectangular film member formed through a pressing process or the like. Specifically, the guide plate 61 is formed of a flexible insulating material, such as polyethylene terephthalate or another resin. A top surface 61*a* of the guide plate 61 is sloped upward in the paper-conveying direction. A base end 61*b* on the upstream end of the guide plate 61 is fixed to a first seat 51*a*. With the guide plate 61 fixed in a sloped state by the first seat 51*a* as described above, a downstream end 61*b* on the downstream end of the guide plate 61 is swingably supported about the base end 61*a* while constantly extending toward the photosensitive drum 27.

The top surface of the first seat 51*a* has a stepped shape in which the region upstream of the region fixing the guide plate 61 is raised an amount greater than or equal to the thickness of the guide plate 61 to prevent paper jams. A second seat 51*b* is formed along the bottom of the first seat 51*a*, and extends toward the transfer position C. The top surface of the second seat 51*b* is formed at a slope to the nip conveying direction ND (parallel to the guide plate 61). The "nip conveying direction ND" is the direction in which the image-carrying member and the transferring unit convey the recording sheet. When the image-carrying member and the transferring unit are both configured of rollers, as in the preferred embodiment, the nip conveying direction ND is the direction along a common tangent to both rollers when viewed from the side (a direction orthogonal to a line connecting the axes of the two rollers).

The first and second seats 51*a* and 51*b* constitute parts of the casing 51. The first and second seats 51*a* and 51*b* may be configured separately from each other or configured separately from the casing 51. Here, the first and second seats 51*a* and 51*b* are immovably fixed in the laser printer 1 when the process cartridge 17 is mounted and immovably fixed in the laser printer 1.

The sponge 62 is a porous member that is softer than the guide plate 61 and has a cross-sectional shape formed as a right trapezoid (a trapezoid having two right angles). Specifically, the sponge 62 has a top surface 62*a*, a bottom surface 62*b* parallel to the top surface 62*a* but having a smaller surface area than the top surface 62*a*, a base endface 62*c* orthogonal to the top surface 62*a* and bottom surface 62*b*, and a distal endface 62*d* that slopes toward the base endface 62*c* from the top surface 62*a* toward the bottom surface 62*b*.

The top surface 62*a* of the sponge 62 is fixed to a bottom surface 61*d* of the guide plate 61 so that a distal edge 62*e* formed at an acute angle protrudes farther toward the photosensitive drum 27 than the distal edge 61*c* of the guide plate 61. Further, the sponge 62 is arranged so that the distal edge 62*e* is positioned a prescribed distance from the photosensitive drum 27, and the bottom surface 62*b* and base endface 62*c* are in contact with the casing second seat 51*b*.

The structure of the preferred embodiment described above has the following effects.

The sponge 62 provided on the guide plate 61 absorbs vibrations in the guide plate 61 generated when the trailing edge of the paper 3 leaves the guide plate 61, thereby suppressing flapping noise by the guide plate 61.

Since the sponge 62 protrudes farther toward the photosensitive drum 27 than the distal edge 61*c* of the guide plate 61, the sponge 62 supports the trailing edge of the paper 3 coming off of the guide plate 61 when the trailing edge swings downward, thereby restraining the trailing edge from flapping. By restraining flapping in the trailing edge of the paper 3, this construction can improve the quality of images formed on the paper 3.

By arranging the sponge 62 with the bottom surface 62*b* in contact with the second seat 51*b*, the sponge 62 is reliably supported on the second seat 51*b* for aligning the distal edge 62*e* of the sponge 62, thereby facilitating such alignment. In the preferred embodiment, the base endface 62*c* is also disposed in contact with the second seat 51*b* along with the bottom surface 62*b* of the sponge 62. Accordingly, the distal edge 62*e* of the sponge 62 can be easily aligned simply by aligning the corner of the sponge 62 in the corner of the second seat 51*b*.

By disposing the bottom surface 62*b* and base endface 62*c* of the sponge 62 in contact with the second seat 51*b* as described above, the sponge 62 can be fixed first to the guide plate 61 and then mounted together with the guide plate 61 on the first seat 51*a* while aligning the corner of the sponge 62 in the corner of the second seat 51*b*, thereby facilitating the mounting operation. Further, since the sponge 62, which functions to absorb vibrations in the guide plate 61, is in contact with the second seat 51*b*, the sponge 62 can quickly damp vibrations in the guide plate 61.

By using the readily deformable sponge 62 as the cushioning member, the guide plate 61 can be suitably bent when printing on a thick sheet of paper 3, thereby reducing the likelihood of paper jams. Further, the sponge 62 used as the cushioning member can absorb noise in the pores formed therein, thereby further enhancing the sound-absorbing effect.

While the invention has been described in detail with reference to specific embodiments thereof, it would be apparent to those skilled in the art that many modifications and variations may be made therein without departing from the spirit of the invention, the scope of which is defined by the attached claims.

For example, the present invention is not limited to the preferred embodiment described above, but may be applied to any of the following structures for the vicinity of the transfer position C.

Figure 3:
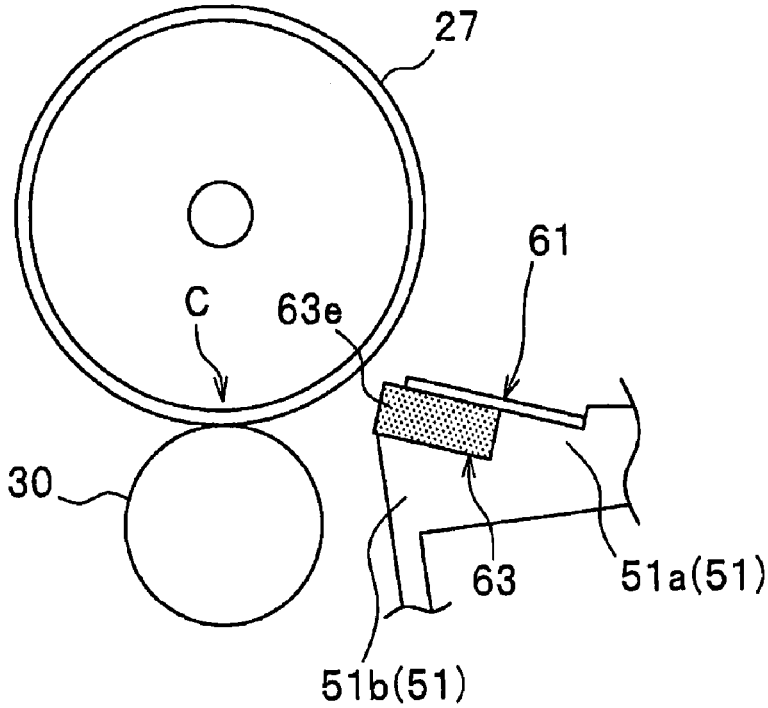
FIG. 3 is a cross-sectional view showing the structure near the transfer position according to a first variation.

As shown in FIG. 3, the structure around the transfer position C in a first variation is configured by modifying the shape of the distal end on the sponge 62 in the preferred embodiment. Specifically, a sponge 63 according to the first variation of the embodiment is a rectangular parallelepiped. Stated differently, the sponge 63 has a distal end portion 63*e* that is prismatic in shape. That is, all corners on the downstream side of the sponge 63 are formed at 90°. Hence, the cross-sectional shape of the sponge 63 is rectangular.

The sponge 63 according to the first variation described above has the following effects.

By forming the sponge 63 with a prismatic distal end portion 63*e*, the sponge 63 can be manufactured as a part to be mounted on the guide plate 61 simply by cutting a prismatic member, for example, thereby reducing manufacturing costs. Further, since the distal end portion 63*e* is prismatic in shape (all angles are 90°), the corner on the top downstream side of the sponge 63 supporting the paper 3 is less likely to buckle under the force of the paper 3, thereby effectively supporting the paper 3 and maintaining the paper 3 at a substantially constant position.

Figure 4:
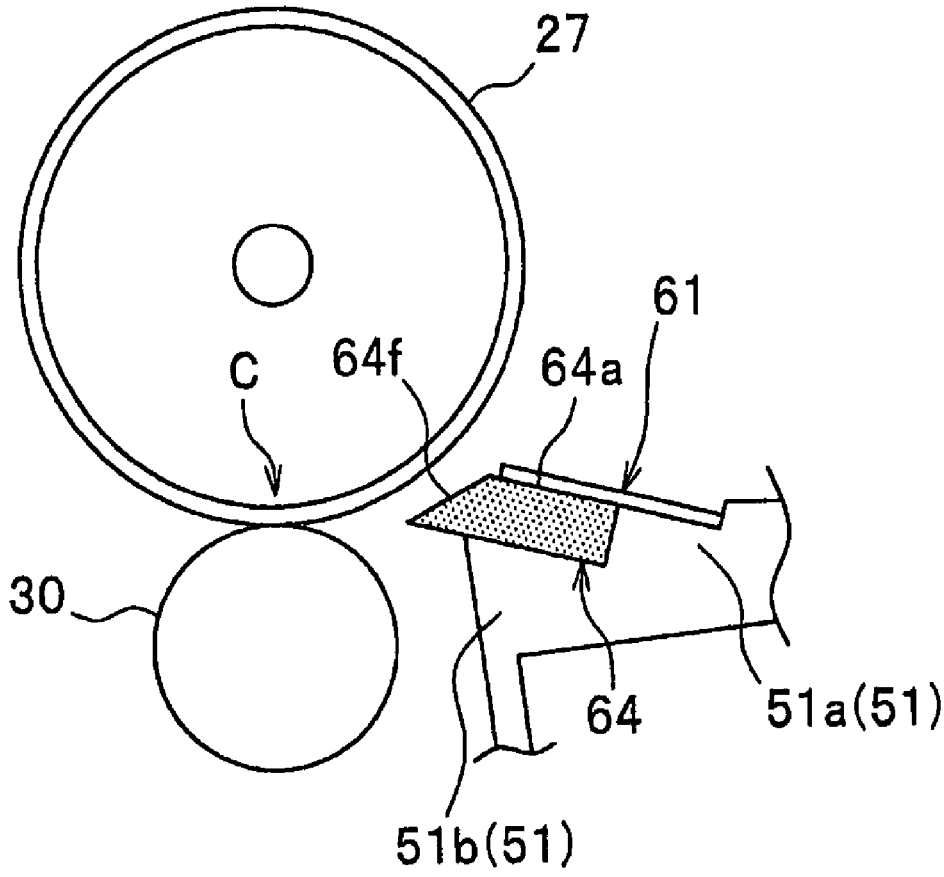
FIG. 4 is a cross-sectional view showing the structure near the transfer position according to a second variation.

As shown in FIG. 4, the structure around the transfer position C according to the second variation is configured by modifying the shape of the distal end on the sponge 62 according to the preferred embodiment (see FIG. 2). Specifically, a sponge 64 according to the second variation has a top surface 64*a*. Part of the top surface 64*a* protruding from the guide plate 61 toward the photosensitive drum 27 is formed as a guide surface 64*f* sloping toward the transfer roller 30 side in the downstream direction. More specifically, the guide surface 64*f* slopes relative to the guide plate 61 so that the upstream portion of the guide surface 64*f* is separated farther from the photosensitive drum 27 than the downstream portion.

The sponge 64 according to the second variation described above has the following effects.

The guide surface 64*f* formed by sloping part of the top surface 64*a* of the sponge 64, as described above, can support the trailing edge of the paper 3 to a position near the transfer position C, thereby restraining flapping in the trailing edge. Further, since the upstream portion of the guide surface 64*f* is separated farther from the photosensitive drum 27 than the downstream portion, the path between the photosensitive drum 27 and the sponge 64 gradually narrows toward the downstream side. Hence, the guide surface 64*f* can receive and smoothly guide the leading edge of the paper 3 toward the photosensitive drum 27, even when the leading edge of the paper 3 is curled downward.

Figure 5A:
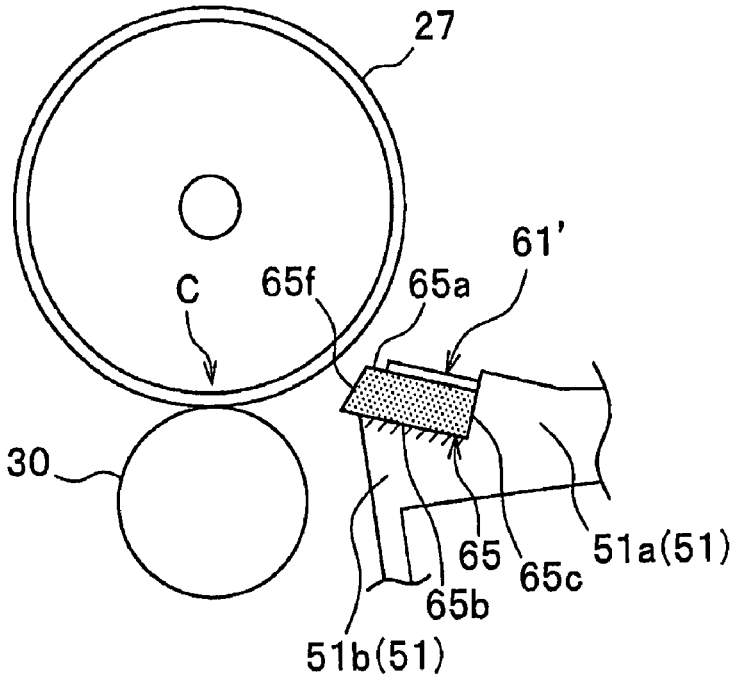
FIG. 5A is a cross-sectional view showing the structure near the transfer position according to a third variation.
Figure 5B:
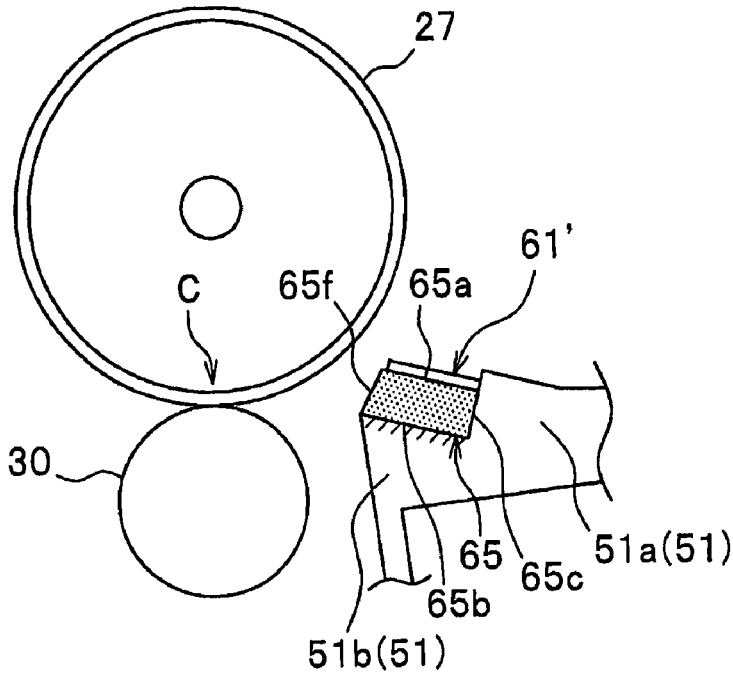
FIG. 5B is a cross-sectional view showing the structure near the transfer position according to a fourth variation.

FIGS. 5A and 5B show the structure around the transfer position C according to third and fourth variations, respectively. As shown in FIGS. 5A and 5B, a sponge 65 has a bottom surface 65*b*, part or all of which is fixed to the top of the second seat 51*b*. A guide plate 61' shorter than a top surface 65*a* of the sponge 65 is fixed on the sponge 65. Further, as in the second variation described above, the portion of the top surface 65*a* that protrudes from the guide plate 61' toward the photosensitive drum 27 is formed as a guide surface 65*f*. The guide surface 65*f* slopes toward the transfer roller 30 in the direction toward the photosensitive drum 27. However, unlike the second variation, the guide surface 65*f* slopes relative to the guide plate 61' so that the upstream portion of the guide surface 65*f* is closer to the photosensitive drum 27 than the downstream portion.

The sponge 65 according to the third and fourth variations described above have the following effects.

The distal end of the sponge 65 can easily be aligned since the sponge 65 is directly fixed to the second seat 51*b*.

In the fourth variation shown in FIG. 5B, the bottom surface 65*b* of the sponge 65 is fixed in its entirety to the second seat 51*b*. Accordingly, the sponge 65 can be set with stability on the second seat 51*b*, facilitating the mounting operation.

The guide surface 65*f* formed by sloping a portion of the top surface 65*a* on the sponge 65 can support the trailing edge of the paper 3 to a point near the transfer position C, thereby restraining flapping in the trailing edge.

While the bottom surface 65*b* of the sponge 65 is fixed to the second seat 51*b* in the third and fourth variations, the present invention is not limited to this configuration. For example, the sponge 65 may be installed with only a base endface 65*c* fixed to the second seat 51*b*, so that the bottom surface 65*b* of the sponge 65 does not contact the second seat 51*b*. This configuration also facilitates positioning of the distal end of the sponge 65 since the sponge 65 is directly fixed to the second seat 51*b*, as described above.

Figure 6A:
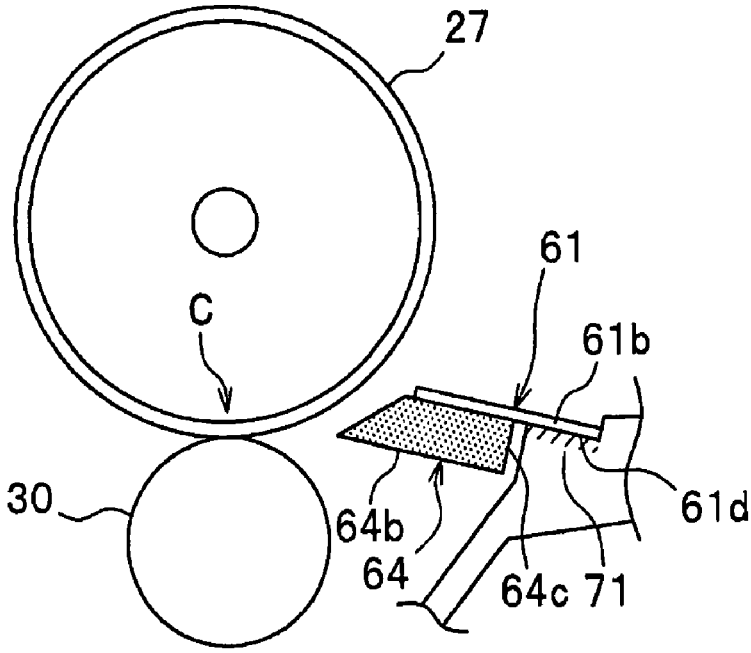
FIG. 6A is a cross-sectional view showing the structure near the transfer position according to a fifth variation.
Figure 6B:
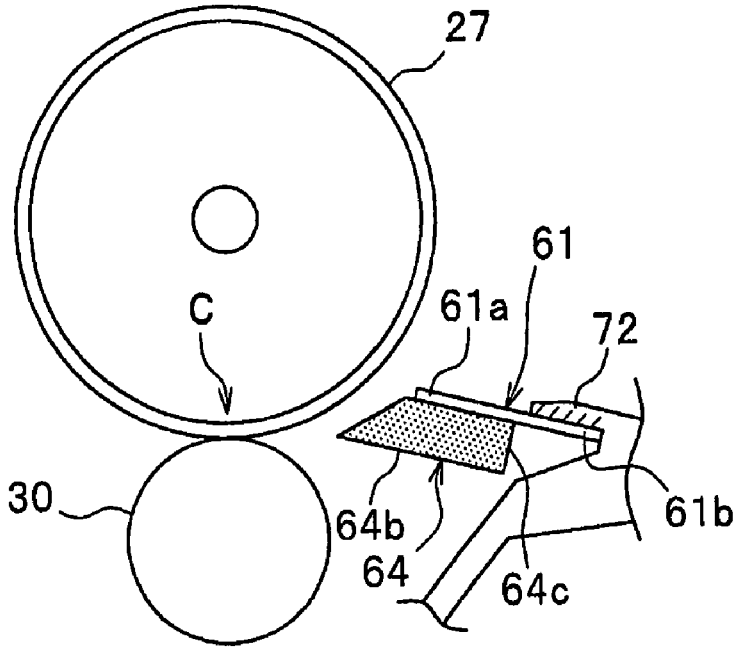
FIG. 6B is a cross-sectional view showing the structure near the transfer position according to a sixth variation.
Figure 6C:
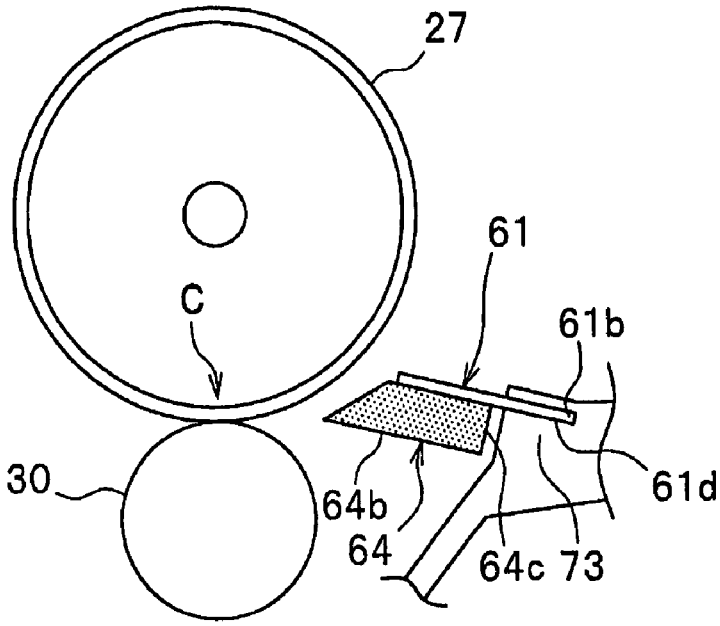
FIG. 6C is a cross-sectional view showing the structure near the transfer position according to a seventh variation.

FIGS. 6A, 6B, and 6C show the structure around the transfer position C according to fifth, sixth, and seventh variations of the embodiment, respectively. As shown in the drawings, the base end 61*b* of the guide plate 61 is fixed to second seats 71, 72, and 73, respectively, while a bottom surface 64*b* of the sponge 64 is fixed to the guide plate 61 in a state not in contact with the respective second seats 71, 72, and 73. More specifically, in the fifth variation shown in FIG. 6A, a bottom surface 61*d* on the base end 61*b* of the guide plate 61 is fixed to the top surface of the second seat 71. In the sixth variation shown in FIG. 6B, the top surface 61*a* on the base end 61*b* of the guide plate 61 is fixed to a bottom surface of the second seat 72 protruding toward the downstream side. In the seventh variation shown in FIG. 6C, the base end 61*b* of the guide plate 61 is embedded in and fixed to the second seat 73. In each of the fifth, sixth, and seventh variations, a base endface 64*c* of the sponge 64 is in a non-contact state with the respective second seats 71, 72, and 73.

While the sponge 64 shown in FIG. 4 is used in the fifth, sixth, and seventh variations, a sponge of any shape may be used.

The structures according to the fifth, sixth, and seventh variations have the following effects.

Since the assembly of the guide plate 61 and sponge 64 protrudes toward the photosensitive drum 27 as a cantilever structure from the respective second seats 71, 72, and 73, the distal end of the sponge 64 can approach the transfer position C, even when other structural components exist below the sponge 64. In other words, since it is not necessary to provide a member for supporting the bottom surface of the sponge 64, there is no interference between such a member supporting the bottom surface of the sponge 64 and other structural components where the distal end of the sponge 64 approaches the transfer position C. Likewise, since the cantilever structure of the guide plate 61 and sponge 64 enables other structural components to be disposed therebeneath, the structures of the present variations enhance freedom of design.

When no components are disposed below the guide plate 61 and sponge 64 (specifically, within the swinging range of the guide plate 61), the cantilever structure makes the guide plate 61 very flexible, more reliably reducing the occurrence of paper jams. Here, the "swinging range" of the guide plate 61 indicates the range in which the guide plate 61 actually flexes and swings due to the force applied by the paper 3 and is a fan-shaped range from the position when the guide plate 61 is in a straight state to the position when the guide plate 61 is bent farthest by a stiff sheet of paper 3, such as a thick sheet of paper.

Further, since the base endface 64*c* of the sponge 64 does not contact the respective second seats 71, 72, and 73, this construction reduces resistance to bending of the guide plate 61 caused by the sponge 64 pressing against the respective second seats 71, 72, and 73, enabling the guide plate 61 to bend sufficiently.

Figure 7:
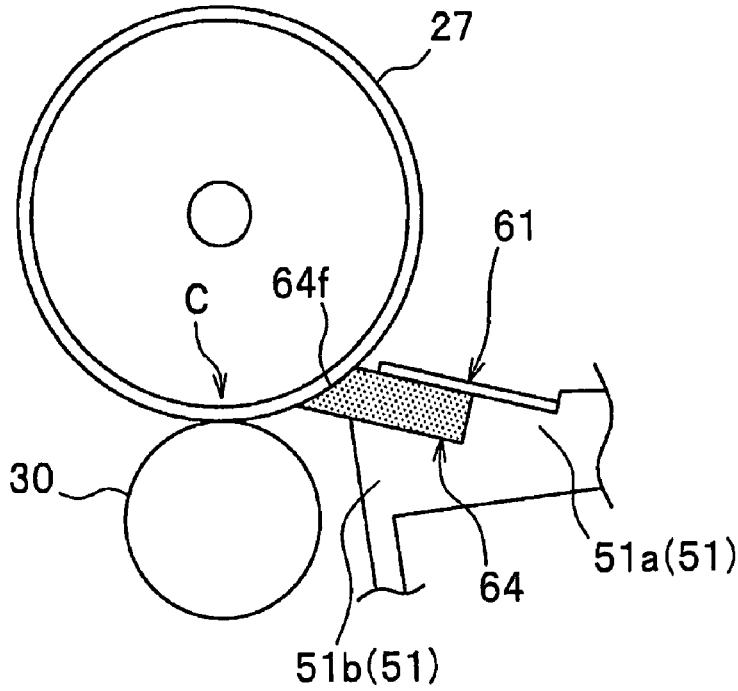
FIG. 7 is a cross-sectional view showing the structure near the transfer position according to an eighth variation.

FIG. 7 shows the structure around the transfer position C according to an eighth variation of the embodiment, which amounts to a small variation of the structure according to the second variation shown in FIG. 4. Specifically, the guide surface 64*f* (distal endface) of the sponge 64 is configured to contact the photosensitive drum 27. While the guide surface 64*f* of the sponge 64 is placed in contact with the photosensitive drum 27 in the eighth embodiment, the present invention is not limited to this configuration. For example, the distal edge 62*e* (corner) of the sponge 62 shown in FIG. 2 may be placed in contact with the photosensitive drum 27.

The structure according to the eighth variation described above has the following effects.

Placing the sponge 64 in contact with the photosensitive drum 27 more reliably restrains flapping in the trailing edge of the paper 3. Further, by forming surface contact between the guide surface 64*f* of the sponge 64 and the photosensitive drum 27, as described in the eighth variation, the paper 3 can be made to follow the shape of the photosensitive drum 27, thereby more effectively suppressing pre-transfer.

Figure 8A:
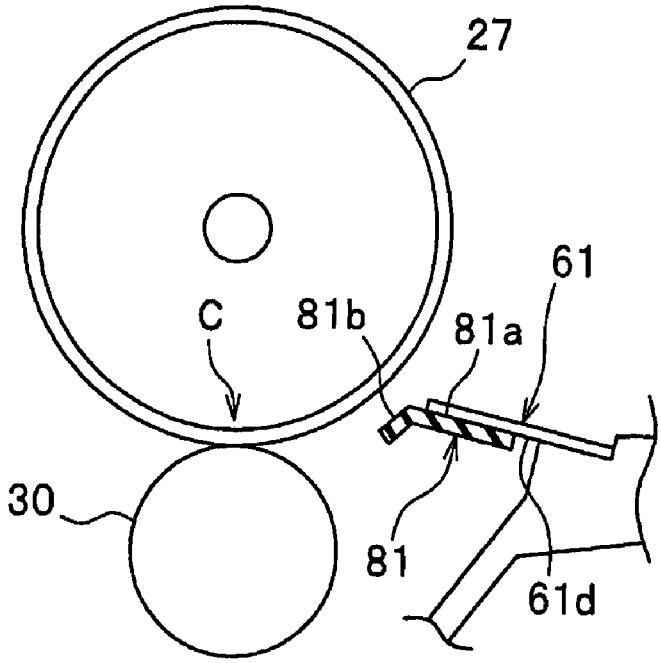
FIG. 8A is a cross-sectional view showing the structure near the transfer position according to a ninth variation.
Figure 8B:
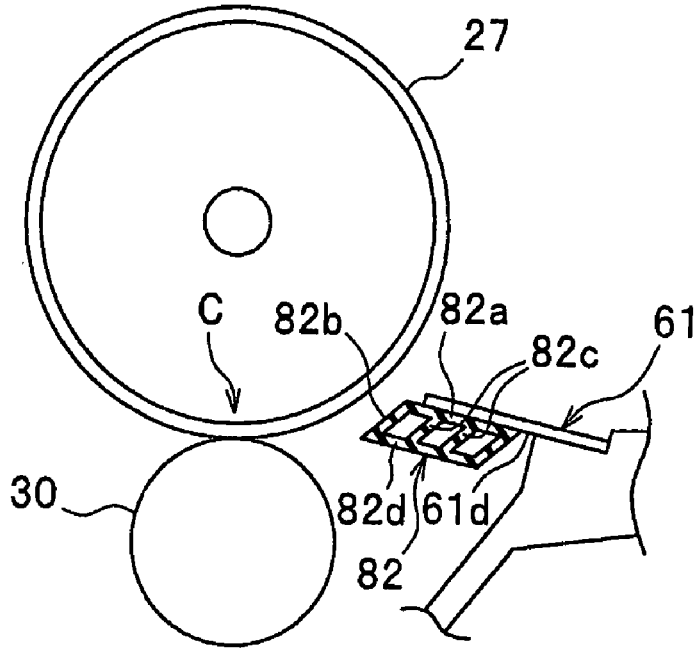
FIG. 8B is a cross-sectional view showing the structure near the transfer position according to a tenth variation.
Figure 8C:
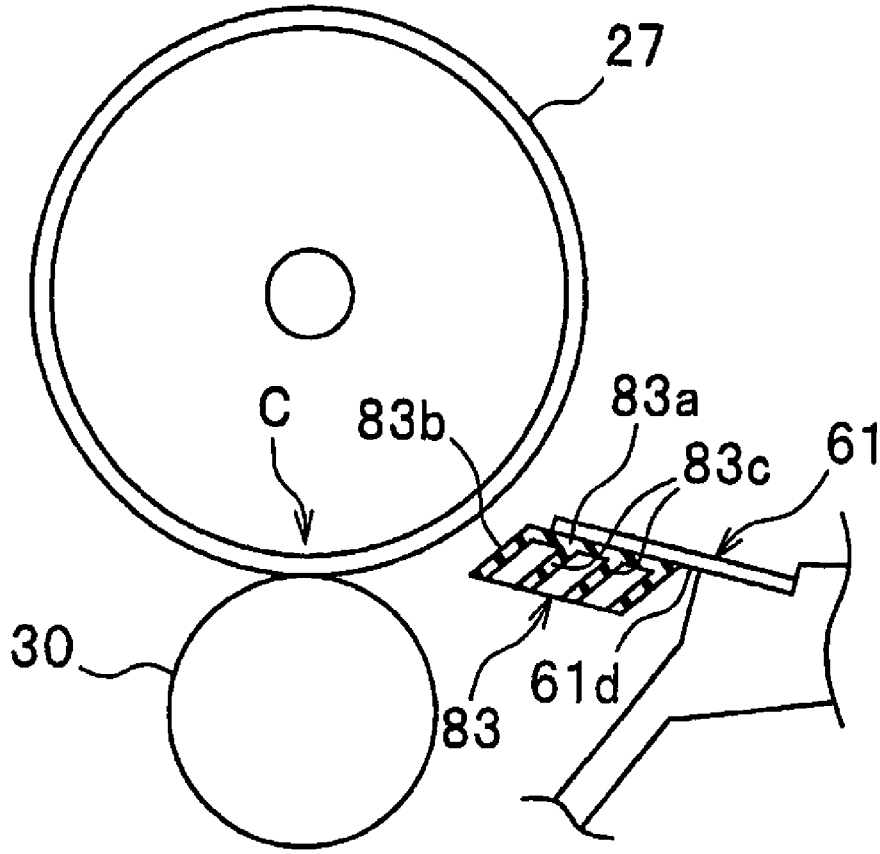
FIG. 8C is a cross-sectional view showing the structure near the transfer position according to an eleventh variation.

FIGS. 8A, 8B, and 8C show the structure around the transfer position C according to ninth, tenth, and eleventh variations, respectively, which amount to a partial modification of the structure according to the fifth variation shown in FIG. 6A. Specifically, rubber members 81, 82, and 83 have a greater stiffness than the sponge 64 and are respectively provided in place of the sponge 64 of the fifth variation. The rubber member 81 of the ninth variation shown in FIG. 8A includes a plate-shaped part 81*a* arranged parallel to the guide plate 61 and fixed to the bottom surface 61*d* of the guide plate 61, and a sloped wall part 81*b* formed integrally from the edge of the plate-shaped part 81*a* on the photosensitive drum 27 side and sloping toward the transfer roller 30 in the direction approaching the photosensitive drum 27 side.

As with the rubber member 81 according to the ninth variation, the rubber member 82 according to the tenth variation shown in FIG. 8B has a plate-shaped part 82*a*, and a sloped wall part 82*b*. In addition, the rubber member 82 includes a plurality of ribs 82*c* arranged parallel to the sloped wall part 82*b*, and a bottom wall part 82*d* arranged parallel to the plate-shaped part 82*a*. The ribs 82*c* are formed on the bottom surface of the plate-shaped part 82*a* with prescribed gaps formed between the neighboring ribs 82*c* and the sloped wall part 82*b*. The bottom wall part 82*d* is integrally formed along the bottom edges of the sloped wall part 82*b* and the ribs 82*c*.

The rubber member 83 according to the eleventh variation shown in FIG. 8C is configured similarly to the rubber member 82 according to the tenth variation, without the bottom wall part 82*d*. Like the rubber member 82 according to the tenth variation, the rubber member 83 is configured of a plate-shaped part 83*a*, a sloped wall part 83*b*, and a plurality of ribs 83*c*.

The structures according to the ninth, tenth, and eleventh variations described above have the following effects.

Since the rubber members 81, 82, and 83 function as cushioning members having a greater stiffness than the sponge, these rubber members can reliably restrain the guide plate 61 from bending too far. In other words, when the guide plate 61 has a cantilever structure, as in the ninth, tenth, and eleventh variations, the guide plate 61 may have a tendency to bend too far when contacted by thick paper or the like. Using the rubber members 81, 82, and 83 in the ninth, tenth, and eleventh variations described above resolves the problem of the guide plate 61 bending excessively.

The cushioning member may also be divided into a plurality of pieces arranged at prescribed intervals in the width direction of the paper (a direction parallel to the surface of the paper and orthogonal to the paper-conveying direction). This structure reduces frictional drag between the paper and the cushioning member, allowing the paper to be conveyed smoothly.

In the preferred embodiment described above, the present invention is applied to the laser printer 1, but the present invention may also be applied to other image-forming devices, such as a photocopier or a multifunction device.

In the preferred embodiment described above, the photosensitive drum 27 serves as an example of the image-carrying member, but the image-carrying member may also be an intermediate transfer belt or a photosensitive belt for carrying toner, for example.

In the preferred embodiment described above, the sponge 62 serves as an example of the cushioning member, but the cushioning member may also be formed of rubber, felt, or the like.

In the preferred embodiment described above, the recording sheet is described as the paper 3, which may be a thick sheet, thin sheet, postcard, and the like, but the recording sheet in the present invention may also be a transparency, for example.

In the preferred embodiment described above, the feeding roller 8, paper dust rollers 10 and 11, and registration rollers 12 serve as an example of the conveying unit, but the present invention is not limited to any particular construction. For example, the conveying unit may be a mechanism for conveying paper inserted by hand through a manual feed tray to the transfer position.

In the preferred embodiment described above, the transfer roller 30 serves as the transferring unit, but the present invention is not limited to this configuration. For example, the transferring unit may be a non-contact type device.

In the preferred embodiment described above, the photosensitive drum 27 is disposed on the top side of the transfer position, and the transfer roller 30 is disposed on the bottom side thereof, but the arrangement of the photosensitive drum 27 and the transfer roller 30 in the present invention may be modified as desired. For example, the laser printer 1 may be configured with the photosensitive drum 27 on the bottom side of the transfer position and the transfer roller 30 on the top side, or with the photosensitive drum 27 on the left side and the transfer roller 30 on the right side.

In the preferred embodiment described above, the nip conveying direction ND follows the horizontal, but the nip conveying direction ND may be sloped relative to the horizontal, for example.

In the preferred embodiment described above, the guide plate 61 is disposed on the process cartridge 17 side, but the guide plate 61 may be disposed on the laser printer 1 side (the main body of the printer) instead.

In the preferred embodiment described above, the sponge 62 is disposed on the process cartridge 17 side, but the sponge 62 may be disposed on the laser printer 1 side (the main body of the printer) instead.

In the preferred embodiment described above, the first seat 51*a* is disposed on the process cartridge 17 side, but the first seat 51*a* may be disposed on the laser printer 1 side (the main body of the printer) instead.

In the preferred embodiment described above, the second seat 51*b* is disposed on the process cartridge 17 side, but the second seat 51*b* may be disposed on the laser printer 1 side (the main body of the printer) instead.

In the preferred embodiment described above, the transfer roller 30 is disposed on the process cartridge 17 side, but the transfer roller 30 may be disposed on the laser printer 1 side (the main body of the printer) instead.

In the preferred embodiment described above, the present invention is applied to a printer that charges toner with a positive polarity, but the present invention may also be applied to a printer that charges toner with a negative polarity.

Further, the distance at which the cushioning member protrudes from the distal end of the guide plate may be set to any arbitrary value, such as approximately 0.5 millimeters, between 1 and several millimeters, or between 1 and several centimeters.

The guide plate may also have one of the following constructions.

(1) The guide plate may be divided into a plurality of pieces that are arranged at prescribed intervals in the width direction of the paper. This configuration can reduce frictional drag between the paper and the guide plate, allowing the paper to be smoothly conveyed.

(2) One or a plurality of slits or notches extending in the paper-conveying direction may be formed in the distal edge of the guide plate. With this construction, the guide plate can be mounted with greater precision and without wrinkling. In this example, holes may be formed at the root of the slit or the like, or the notches may be shaped substantially rectangular or substantially U-shaped, for example, to prevent the guide plate from splitting along the slits or notches.

(3) When the guide plate is formed according to a pressing process, the surface of the plate that is first contacted by the cutting blade in the pressing process, i.e. the shear-drooped side, has smooth or rounded edges, while the side opposite the shear-drooped side may have edges or burrs. Since the paper may catch on these burrs, the guide plate is preferably disposed with the shear-drooped side as the top surface that contacts the paper to ensure that the paper is smoothly conveyed.

What is claimed is:

1. An image-forming device comprising:

an image-carrying member that carries a developer image;

a transferring unit that is disposed in confrontation with the image-carrying member and transfers the developer image on the image-carrying member to a recording sheet;

a conveying unit that conveys the recording sheet to a transfer position between the image-carrying member and the transferring unit;

a guide plate having a first surface, a second surface opposite the first surface, a side surface farthest from the image-carrying member, a first edge nearest to the image-carrying member, and a second edge portion farthest from the image-carrying member, the guide plate supporting the recording sheet conveyed by the conveying unit on the first surface and guiding the recording sheet toward the image-carrying member;

a seat that supports the guide plate, the side surface farthest from the image-carrying member being fixed to the seat; and a cushioning member disposed at a side of the second surface of the guide plate and fixed to the second surface of the guide plate, the cushioning member being formed from a material softer than a material of the guide plate, wherein the cushioning member protrudes farther toward the image-carrying member than the first edge of the guide plate.

2. The image-forming device according to claim 1, wherein the cushioning member is a rectangular parallelepiped.

3. The image-forming device according to claim 1, wherein the cushioning member has a knife edge portion protruding farther toward the image-carrying member than the first edge of the guide plate.

4. The image-forming device according to claim 3, wherein the cushioning member has a distal endface with which the recording sheet is brought into contact, the distal endface sloping toward the transferring unit.

5. The image-forming device according to claim 4, wherein the cushioning member has a top surface attached to the second surface of the guide plate, a bottom surface parallel to the top surface, a base endface orthogonal to the top surface and the bottom surface, and the distal endface that slopes from the top surface toward the bottom surface, the top surface having a smaller surface than the bottom surface.

6. The image-forming device according to claim 1, further comprising a seat, wherein the cushioning member has a surface in contact with the seat.

7. The image-forming device according to claim 1, further comprising a seat, wherein the cushioning member is fixed to the seat.

8. The image-forming device according to claim 1, further comprising a seat, wherein the second edge portion of the guide plate is fixed to the seat, and the cushioning member is fixed to the guide plate while being separated from the seat.

9. The image-forming device according to claim 1, wherein the cushioning member has an end portion in contact with the image-carrying member.

10. The image-forming device according to claim 1, wherein the cushioning member is formed from sponge.

11. The image-forming device according to claim 1, wherein the cushioning member is formed from rubber.

12. A process cartridge detachably mounted in an image-forming device, the process cartridge comprising:

a photosensitive drum that carries a developer image, the developer image being transferred to a recording sheet;

a conveying unit that conveys the recording sheet to a transfer position between the photosensitive drum and the transferring unit;

a guide plate having a first surface, a second surface opposite the first surface, a side surface farthest from the image-carrying member, a first edge nearest to the image-carrying member, and a second edge portion farthest from the photosensitive drum, the guide plate supporting the recording sheet conveyed by the conveying unit on the first surface and guiding the recording sheet toward the photosensitive drum;

a seat that supports the guide plate, the side surface farthest from the image-carrying member being fixed to the seat; and a cushioning member disposed at a side of the second surface of the guide plate and fixed to the second surface of the guide plate, the cushioning member being formed from a material softer than a material of the guide plate, wherein the cushioning member protrudes farther toward the image-carrying member than the first edge of the guide plate.

13. The process cartridge according to claim 12, wherein the cushioning member is a rectangular parallelepiped.

14. The process cartridge according to claim 12, wherein the cushioning member has a knife edge portion protruding farther toward the image-carrying member than the first edge of the guide plate.

15. The process cartridge according to claim 14, wherein the cushioning member has a top surface attached to the second surface of the guide plate, a bottom surface parallel to the top surface, a base endface orthogonal to the top surface and the bottom surface, a distal endface which the recording sheet brings into contact and slopes from the top surface toward the bottom surface, the top surface having a smaller surface than the bottom surface.

16. The process cartridge according to claim 12, further comprising a seat, wherein the cushioning member has a surface in contact with the seat.

17. The process cartridge according to claim 12, further comprising a seat, wherein the cushioning member is fixed to the seat.

18. The process cartridge according to claim 12, further comprising a seat, wherein the second edge portion of the guide plate is fixed to the seat, and the cushioning member is fixed to the guide plate while being separated from the seat.

19. The process cartridge according to claim 12, wherein the cushioning member has an end portion in contact with the image-carrying member.

20. The process cartridge according to claim 12, wherein the cushioning member is formed from sponge.

21. The process cartridge according to claim 12, wherein the cushioning member is formed from rubber.

* * * * *